US006672448B2

(12) United States Patent
Arai et al.

(10) Patent No.: US 6,672,448 B2
(45) Date of Patent: Jan. 6, 2004

(54) TRANSFER DEVICE

(75) Inventors: Toshihiko Arai, Kanagawa-ken (JP); Nobuyoshi Maeda, Kanagawa-ken (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 10/164,287

(22) Filed: Jun. 5, 2002

(65) Prior Publication Data

US 2002/0175052 A1 Nov. 28, 2002

Related U.S. Application Data

(63) Continuation-in-part of application No. 09/793,692, filed on Feb. 26, 2001, now abandoned.

(30) Foreign Application Priority Data

Mar. 10, 2000 (JP) ..... 2000-067109

(51) Int. Cl.[7] ..... B65G 25/02
(52) U.S. Cl. ..... 198/621.1; 72/405.13
(58) Field of Search ..... 198/621.1, 621.2, 198/621.3, 621.4; 72/405.13, 405.07

(56) References Cited

U.S. PATENT DOCUMENTS 3,754,667 A * 8/1973 Storch ..... 198/218
3,757,961 A * 9/1973 Jacobs ..... 198/218
4,697,449 A * 10/1987 Harsch et al. ..... 198/621
4,819,786 A * 4/1989 Tanaka et al. ..... 198/621
4,896,523 A * 1/1990 Knight ..... 198/621
5,074,141 A * 12/1991 Takeuchi ..... 198/621
5,097,695 A * 3/1992 Brzezniak ..... 198/621
5,148,697 A 9/1992 Shiraishi et al. ..... 72/405
5,159,827 A * 11/1992 Shiraishi et al. ..... 198/621
5,269,168 A * 12/1993 Ogawa ..... 198/621
RE34,581 E * 4/1994 Sofy et al. ..... 198/621
5,802,967 A * 9/1998 Thudium et al. ..... 198/621.1
5,899,108 A * 5/1999 Hofele et al. ..... 198/621.1
5,975,284 A * 11/1999 Kato ..... 198/621.1
5,983,696 A * 11/1999 Maher ..... 198/621.2
6,530,467 B2 * 3/2003 Arai et al. ..... 198/468.5
6,604,402 B2 * 8/2003 Arai et al. ..... 198/621.1

FOREIGN PATENT DOCUMENTS

DE 195 06 079 8/1996 ..... B21D/43/05
FR 78 29900 2/1980 ..... B30B/15/26
GB 1 044 694 A * 10/1996 ..... 198/621.1
JP 97/27960 8/1997 ..... B21D/43/05

* cited by examiner

*Primary Examiner*—Douglas Hess
(74) *Attorney, Agent, or Firm*—Darby & Darby

(57) ABSTRACT

A transfer device having high productivity and is compact. The present invention uses cross bars that have a blank attachment member that are suitable for transferring large blank materials that, prior to processing, do not have rigidity. These large blank materials have a tendency to sag in the center and are difficult to transport. The present invention also jointly uses fingers that are suitable for rapid transport of blank materials that, after processing, are molded and have rigidity.

11 Claims, 6 Drawing Sheets

3
6
21
B
21a
A
UNCLAMP
CLAMP
ADVANCE
RETURN
17
19b
17
BLANK MATERIAL
18a
18a
20
X
X
18a
19a
18a
CLAMP
UNCLAMP
6
21
A
21a
B
3

TRANSFER DEVICE

This is a continuation-in-part of application Ser. No. 09/793,692 filed Feb. 26, 2001, now abandoned.

BACKGROUND OF THE PRESENT INVENTION

1. Field of the Invention

The present invention relates to a transfer device equipped with feed bars having fingers for gripping an end part of a blank. The present invention also relates to a transfer device equipped with cross bars having a blank attachment member.

2. Description of the Related Art

For transfer devices having a feed bar placed in the blank transfer direction, the typical method of transfer is to grasp the end part of a blank material with a clamping motion of a pair of feed bars that are arranged parallel to each other. For example, the operation can be conducted at an approximate stroke of 45 times per minute. However, as the front-back measurement of the blank material becomes larger (for example, 1,300 mm or greater) there is sagging of the center portion of the blank material because the blank material loses rigidity. Transfer is especially difficult in the steps prior to the processing the blank material, e.g. bending or the like.

With large blank materials (for example, blank materials of 2,500 mm or greater), there is the cross-bar method in which transfer occurs by having a blank attachment member that attaches to the upper surface of the blank material. With a lifting and lowering motion, after attaching to the blank material, the cross bars transfer the blank material to the next stage. The cross-bars are held in a position that does not interfere with the die during processing, and after the processing, they return to the previous stage to transport the next blank material.

For the cross-bar method as described above, a large amount of time is needed for the motions for one cycle, and as a result, the mechanical device averages only 10 strokes per minute. Compared to the transfer by the previously described fingers, the productivity is reduced. Furthermore, a driving device for moving the cross bars must be provided on the feed bars. As a result, the mechanical device becomes large.

Thus, there is still a need in the art to develop a transfer device that can move large blank materials at a high rate of speed and is of a compact size.

OBJECT AND SUMMARY OF THE INVENTION

It is the foregoing and various other drawbacks of the prior art which the present invention seeks to overcome by providing a transfer device that has high productivity and is compact.

The present invention uses cross bars that have a blank attachment member and that are suitable for transferring large blank materials that, prior to processing, do not have rigidity, sag in the center and are difficult to transport. Additionally, the present invention also jointly uses fingers that are suitable for rapid transport of blank materials that, after processing, are molded and have rigidity.

The transfer device of the present invention has a construction in which two types of transfer devices are jointly used. These two types are cross bars that have a blank attachment member and fingers for gripping the blank end parts. The invention is a transfer device having a pair of parallel arranged feed bars.

Two types of transferring devices are used concurrently. One type of transferring device is cross bars that span the feed bars and that have a blank attachment member and are used for transferring a blank material, which has been brought to an idle stage of the transfer device, to a next stage. A second type of transferring device is fingers for gripping blank end parts and are used for each downstream stage from the second stage and beyond the feed bars. Further, the transfer device may include a rack formed in a center portion of the pair of cross bars. One of the facing ends of cross bars are fixed on guides, which are affixed to the upper surfaces of the feed bars, and the other ends are slidably guided. In addition, a pinion is rotatably provided on a plate that is joined near the center part of the cross bars, and the pinion meshes with the rack to construct a rack-pinion mechanism.

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

DESCRIPTION OF THE PREFERRED EMBODIMENTS

Figure 1:
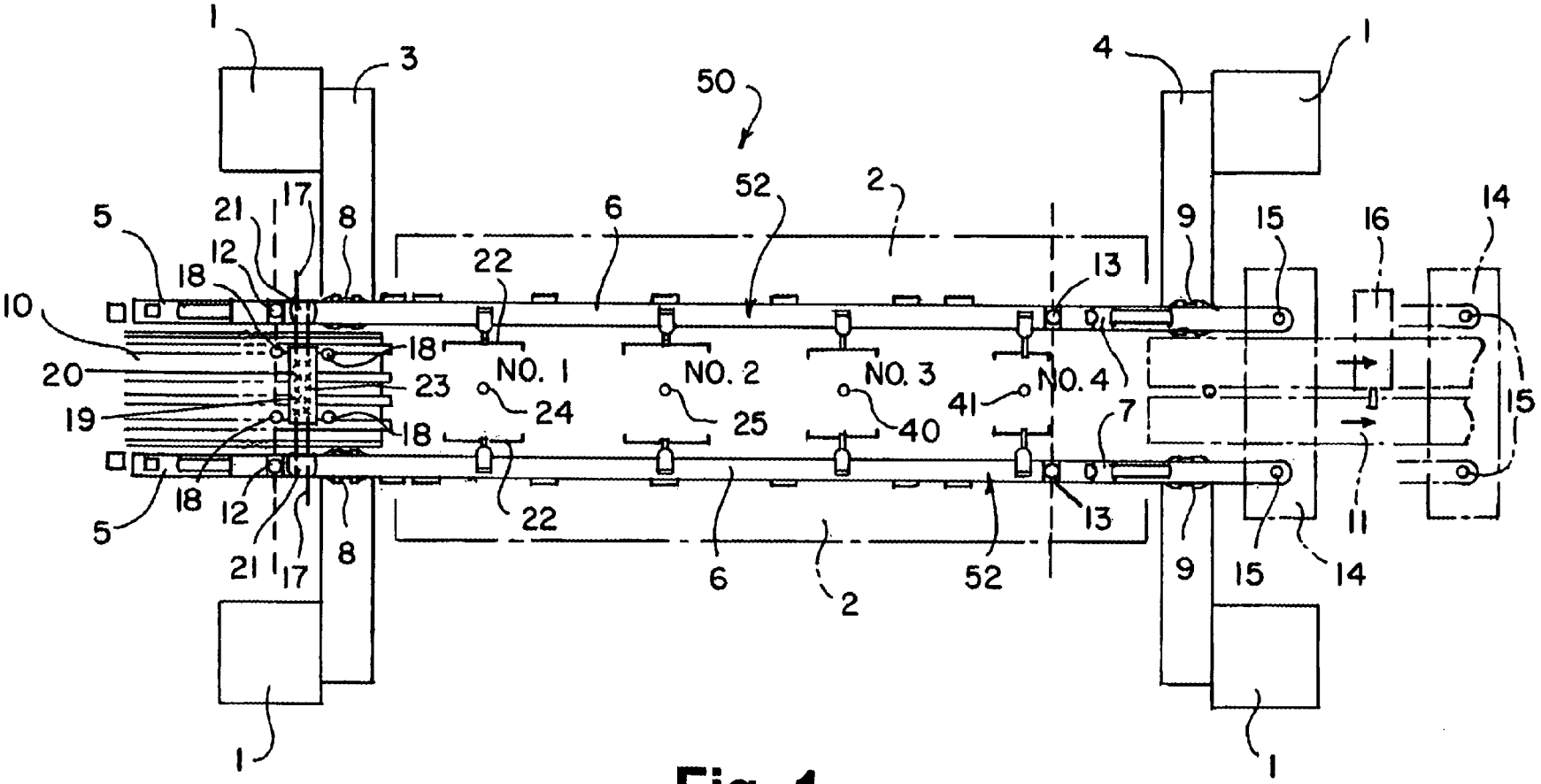
FIG. 1 is a plan view of a transfer device according to the present invention.

Referring to FIG. 1, an embodiment of the present invention is illustrated. FIG. 1 illustrates a press machine 50 equipped with a bed 42. A crown is supported on this bed 42 via a column 1. Bolster 2 is located on top of bed 42, the bolster 2 may be fixed or may shift location. A slide that can move vertically with respect to bolster 2 is provided. A plurality of lower molds and upper molds are attached on the opposing surfaces of bolster 2 and the slide. In addition, pairs of feed bars 5, 6, 7 that transport the blank materials from die to die are arranged parallel to each other and are placed on top of the bolster 2.

Feed rails 52 are constructed from three sections of feed bars 5, 6, 7. Feed bars 5 and feed bars 6 are detachable from each other by a joint 12. Similarly, feed bars 6 and feed bars 7 are detachable from each other by a joint 13. This configuration is convenient for removing only sections of the press machine 50 at a time. For example, only feed bars 6 need to be removed together with the moving bolster 2 when exchanging dies.

A slider 14 that guides feed rails 52 in the transfer direction is linked to feed bars 7. On slider 14, there are upright pins 15, and they can be inserted into holes opened on the end of feed bars 7.

Furthermore, slider 14 conducts an advance/return motion by a rack-pinion construction having a servo motor 16 as the driving means. In conjunction with this motion, feed rails 52 also conduct an advance-return motion (refer to FIG. 2).

In addition, feed bars 6 and feed bars 7 are received by U-shaped guide parts 8 and guide parts 9. Guide parts 8, and 9 conduct a clamp-unclamp motion (refer to FIG. 2) by a ball-screw mechanism that has a driving means of a servo motor that is provided on a clamp lift unit 3 and clamp lift unit 4. In addition, guide parts 8 and guide parts 9 conduct a lifting and lowering motion (illustrated in FIG. 3) by a rack-pinion mechanism that has as a driving means, and a different servo motor inside clamp lift unit 3 and clamp lift unit 4.

The above embodiment allows the feed bars 5, 6, and 7 to conduct three-dimensional motions. However, another embodiment will allow feed bars 5, 6, and 7 to conduct two-dimensional motions in relation to a horizontal plane. In this embodiment, a cylinder 18*a* is provided on blank attachment member 18, that is attached to a plate 20 provided on cross bar 17. This arrangement allows the press machine 50 to conduct the lifting and lowering motion of only blank attachment member 18.

In addition, a conveyor belt 10 and a conveyor belt 11 are installed on the transfer device for bringing in and taking out the blank material. Conveyor belt 10 brings in blank materials to idle stage 23 at a constant pitch. Conveyor belt 11 brings out the product that has completed the final processing to a product receiver.

Feed bars 6 are equipped with cross bars 17 and fingers 22 for gripping the blank end part. In conjunction with the three dimensional or two dimensional movement of feed rails 52, cross bars 17 and fingers 22 for gripping the blank end part to transfer the blank materials to the next stage in sequence.

Guides 21 for installing cross bars 17 are affixed to feed bars 6. One of the facing ends A of the pair of crossbars 17 are affixed to guide 21. In addition, the opposite the facing ends B of cross bars 17 are slidably guided by guide 21.

A plate 20 is provided on cross bars 17. In addition, a blank attachment member 18, such as a vacuum cup or magnet, is provided on plate 20. A rack 19*b* is formed in the center part of cross bars 17. The rack meshes with a pinion 19*a* that is rotatably provided on plate 20, and a rack and pinion mechanism 19 is constructed. Blank attachment member 18 is always maintained at a middle point between feed bars 6.

Figure 2:
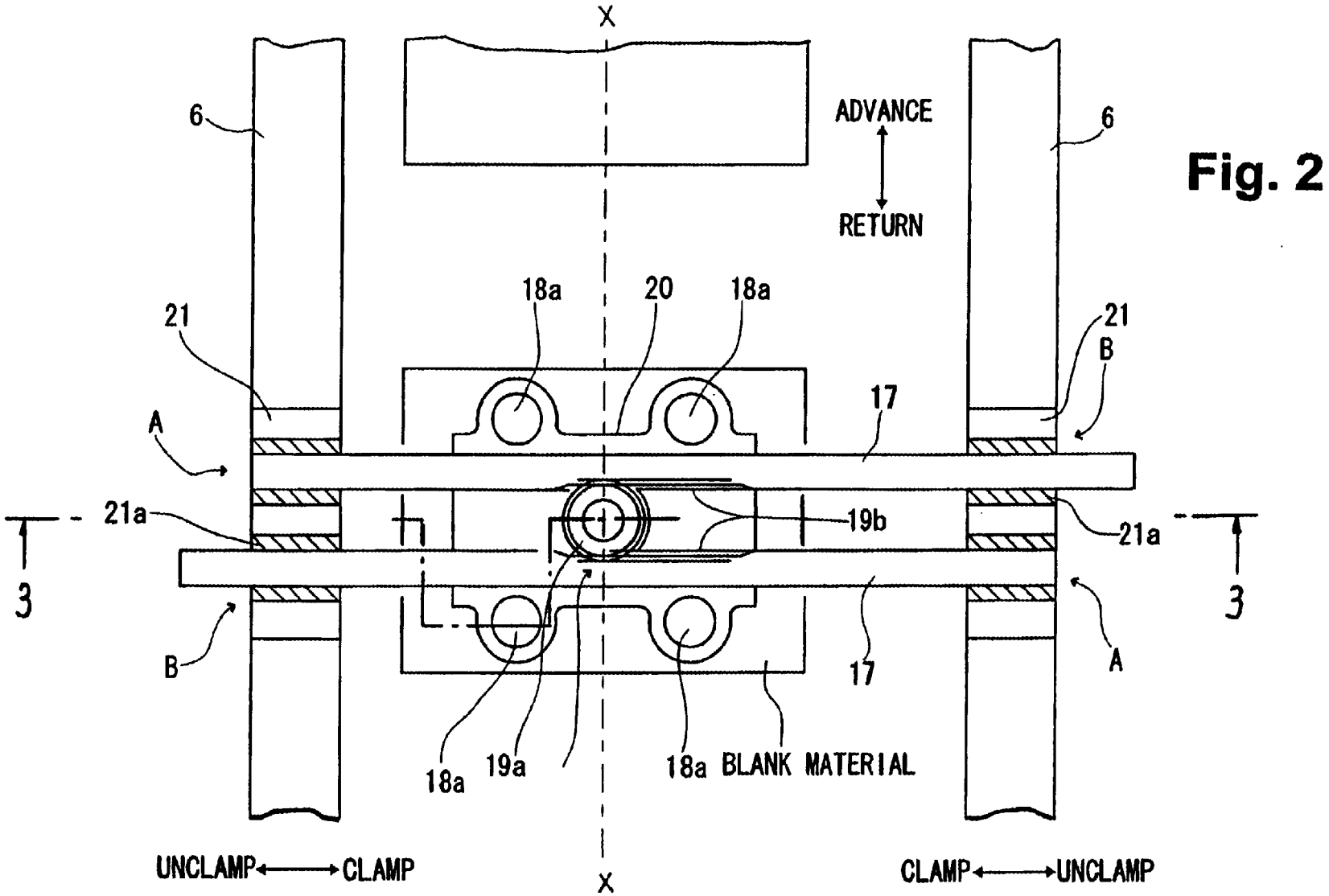
FIG. 2 is an enlarged detail of the top view of the transfer device of FIG. 1.
Figure 3:
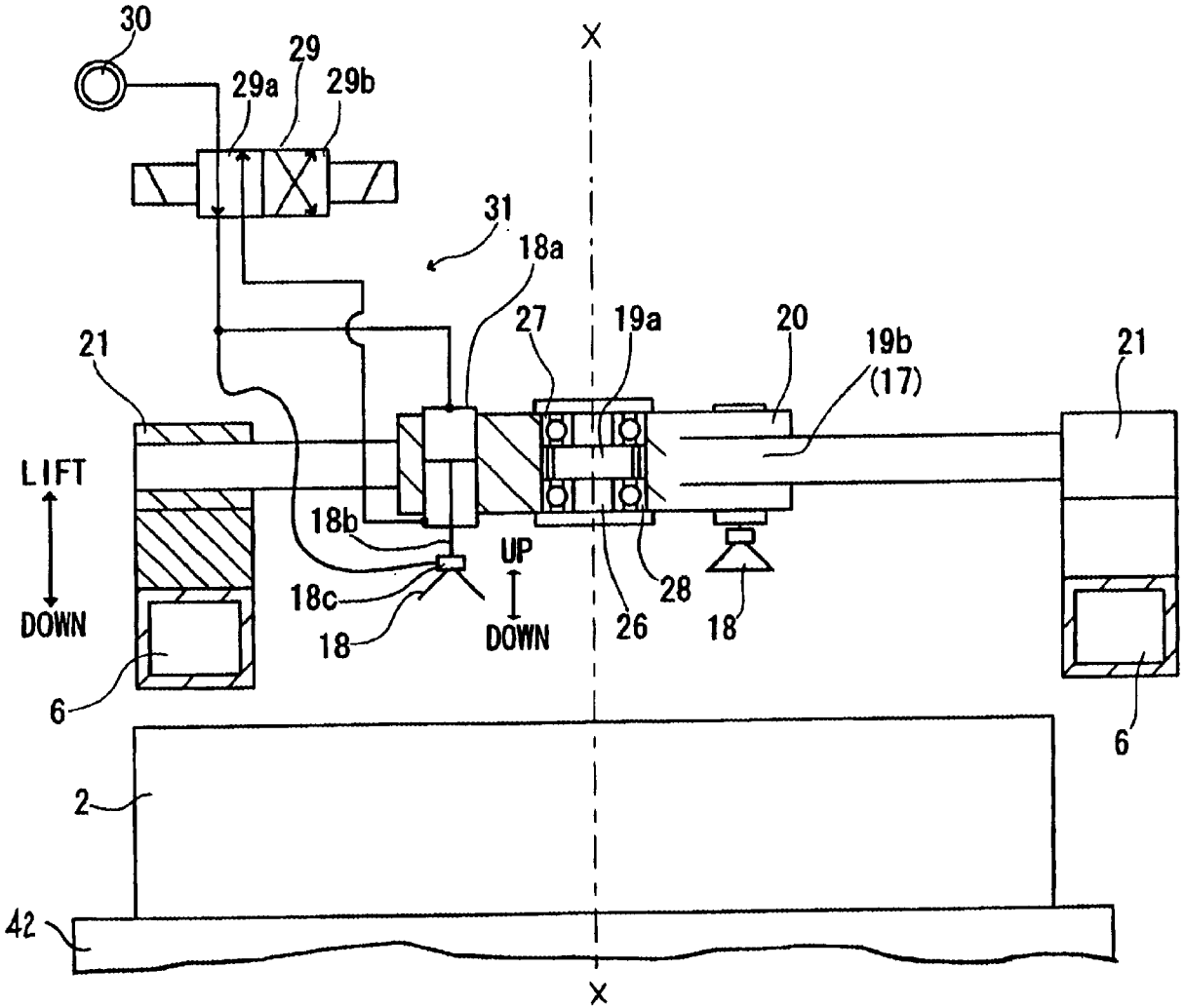
FIG. 3 is a longitudinal section taken along lines 3—3 of FIG. 2.

Referring to FIGS. 2 and 3, a detailed drawing of the principal parts in the area of blank attachment member 18 and plate 20 is shown. FIG. 2 illustrates a detailed drawing in which the principal parts of FIG. 1 are enlarged. FIG. 3 is a longitudinal cross-section of FIG. 2 viewed across line 3—3. Furthermore, referring to FIGS. 2 and 3, both are spilt by dividing line X—X, the illustration to the right half of dividing line X—X illustrates the condition when feed bars 6 are unclamped, and the illustration to the left half of dividing line X—X illustrates the condition when feed bars 6 are clamped.

As described above, facing ends A of cross bars 17 are anchored to guide 21. The other facing ends B are slidably guided by bushing 21*a* of guide 21. Also, plate 20 is slidably provided on two cross bars 17. A pinion gear 19*a* is provided at the center of plate 20. A pin 26 is affixed to pinion gear 19*a*. Pin 26 is rotatably supported by bearings 27, 28. Therefore, pinion gear 19*a* is rotatably supported. Rack 19*b* is provided at the center part of cross bars 17. Pinion gear 19*a* and rack 19*b* engage to construct a rack pinion mechanism 19.

Furthermore, as described above, blank attachment member 18 is provided on plate 20. Blank attachment member 18 is provided at Four sites. In the present embodiment, blank attachment member 18 is formed by a vacuum cup. Blank attachment member (vacuum cup) 18 is affixed to a piston rod 18*b* which joins with cylinder 18*a*. A vacuum generating device 18*c* provided at the top of vacuum cup 18 creates a vacuum in the interior of vacuum cup 18 when air enters vacuum generating device 18*c*.

An air circuit 31, which includes electromagnetic valve 29 and an air source 30, is connected to cylinder 18*a*. Piston rod 18*b* and blank attachment member (vacuum cup) 18 which is affixed thereto move up and down by the switching of electromagnetic valve 29. Thus, when electromagnetic valve 29 is in condition 29*a*, air will enter the upper chamber of cylinder 18 and blank attachment member (vacuum cup) 18 is lowered. In addition, because air also enters vacuum generating device 18*c*, the inside of blank attachment member (vacuum cup) 18 becomes a vacuum, and blank material is attached to blank attachment member (vacuum cup) 18.

When electromagnetic valve 29 is in condition 29*b*, air enters the lower chamber of cylinder 18*a*. As a result, blank attachment member (vacuum cup) 18 rises. At this time, because air does not enter vacuum generating device 18*c*, the attachment is released.

The series of motions of the transfer device is now described. The blank material that has been transferred to idle stage 23 by conveyor belt 10 is brought to first stage 24 by blank attachment member 18. The blank material that has been molded by a die is transferred from first stage 24 to second stage 25 by fingers 22 for gripping the blank end part. Similarly, the product is molded in sequence at each of the stages downstream from second stage 25 (i.e third stage 40 and fourth stage 41). The final product is brought to a product receiver by conveyor belt 11.

Figure 4A:
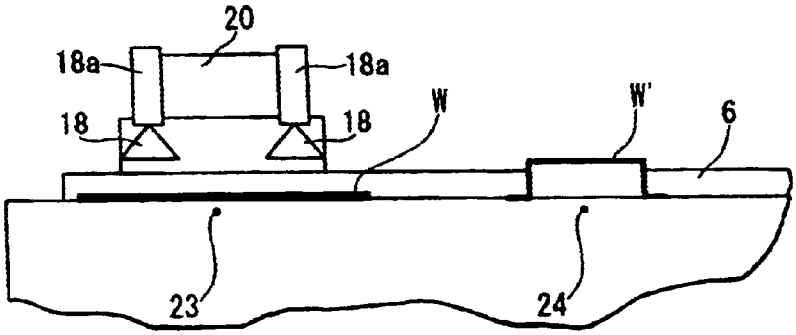
FIGS. 4A–4F illustrate the sequence of steps performed by the transfer device of the present invention.

Referring to FIGS. 4A through 4F, the sequence of steps performed by the transfer device of the present invention are illustrated in further detail. FIG. 4A illustrates the principal parts of the transfer device as viewed from the side. The sequence from 4A–4F, consists of blank material W being transported from idle stage 23 to first stage 24.

As illustrated in FIG. 4A, blank material W is transported to idle stage 23, and a blank material that has been pressed (partially fabricated product W') is mounted at the first stage 24. Presently, feed bar 6 is in the "down" position. In addition, a clamping motion is conducted, and partially fabricated product W' is held between fingers 22. By the action of rack-pinion mechanism 19, plate 20 is maintained at a center position in the clamp-unclamp direction (i.e. along the midline between feed bars 6).

Figure 4B:
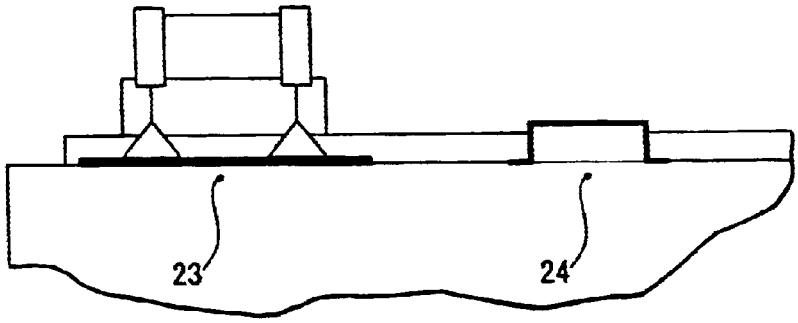

FIG. 4B illustrates the next series of steps. Almost simultaneously with the clamping action of feed bar 6, blank attachment member (vacuum cup) 18 is lowered. Once lowered, it is possible to attach blank material W to blank attachment member (vacuum cup) 18. Thus, blank material W is attached to attachment member (vacuum cup) 18.

Figure 4C:
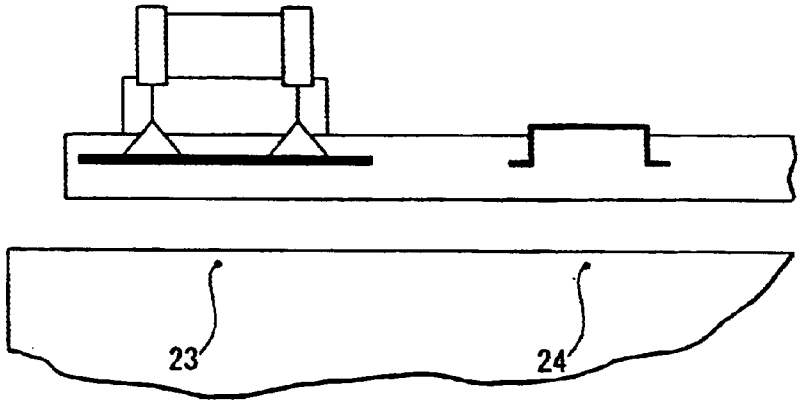

FIG. 4C illustrates feed bar 6 being raised by a lifting motion. Blank material W is attached and held by blank attachment member (vacuum cup) 18. Partially fabricated product W' is held between fingers 22.

Next, feed bar 6 advances up the line. Also, conveyor 10 (FIG. 1) transports the next blank material W to idle stage 23 (see FIG. 4D).

Figure 4D:
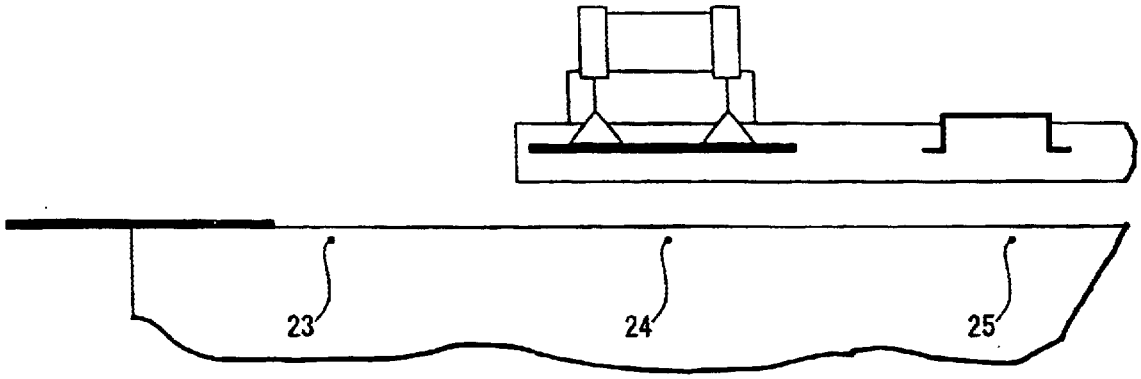
Figure 4E:
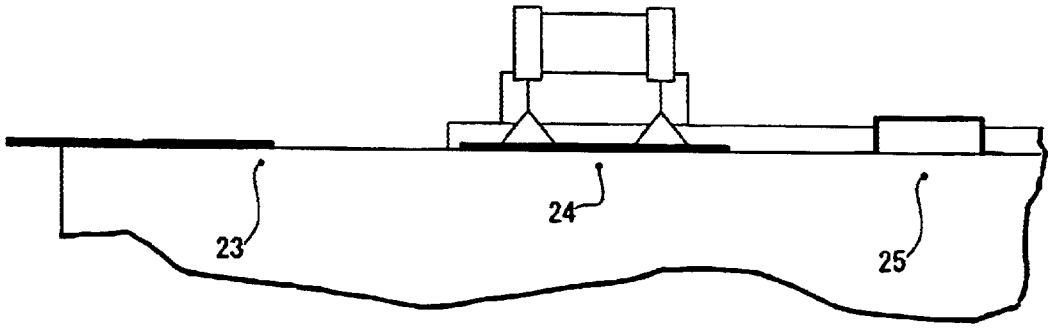

FIG. 4E illustrates feed bar 6 performing a downward motion. Blank material W is transported to first stage 24. Partially fabricated product W' is transported to second stage 25.

Lastly, the suction is released from the blank attachment member (vacuum cup) 18, and blank attachment member 18 is raised. Afterwards, feed bar 6 is unclamped, and the partially fabricated product W' is released from its hold. Thereupon, a slide of a press (not shown) is lowered and pressing is conducted at each of the stages. At this time, feed bar 6 has a returning motion, and after pressing, the conditions become restart as illustrated in FIG. 4A.

As described above, by linking the motions of FIGS. 4A–4F with the motions of the slide (upper mold) of the press (not shown), pressing can be conducted continuously.

Furthermore, by the clamping motion of feed bar 6 and the lowering motion of blank attachment member (vacuum cup) 18, the timing for the motions is set according to the dies and product to be manufactured so as to avoid interference.

Figure 4F:
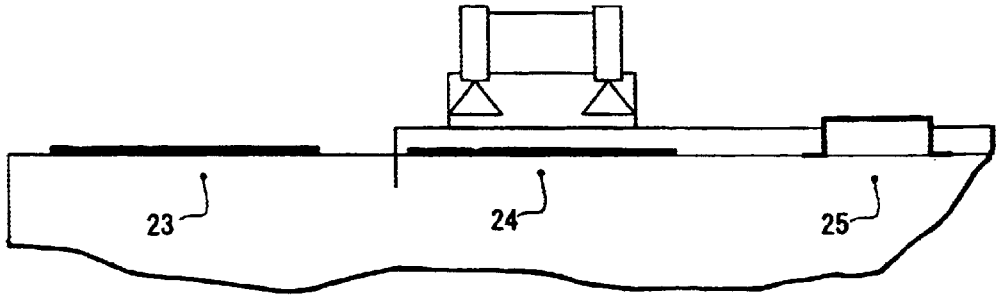
Figure 5:
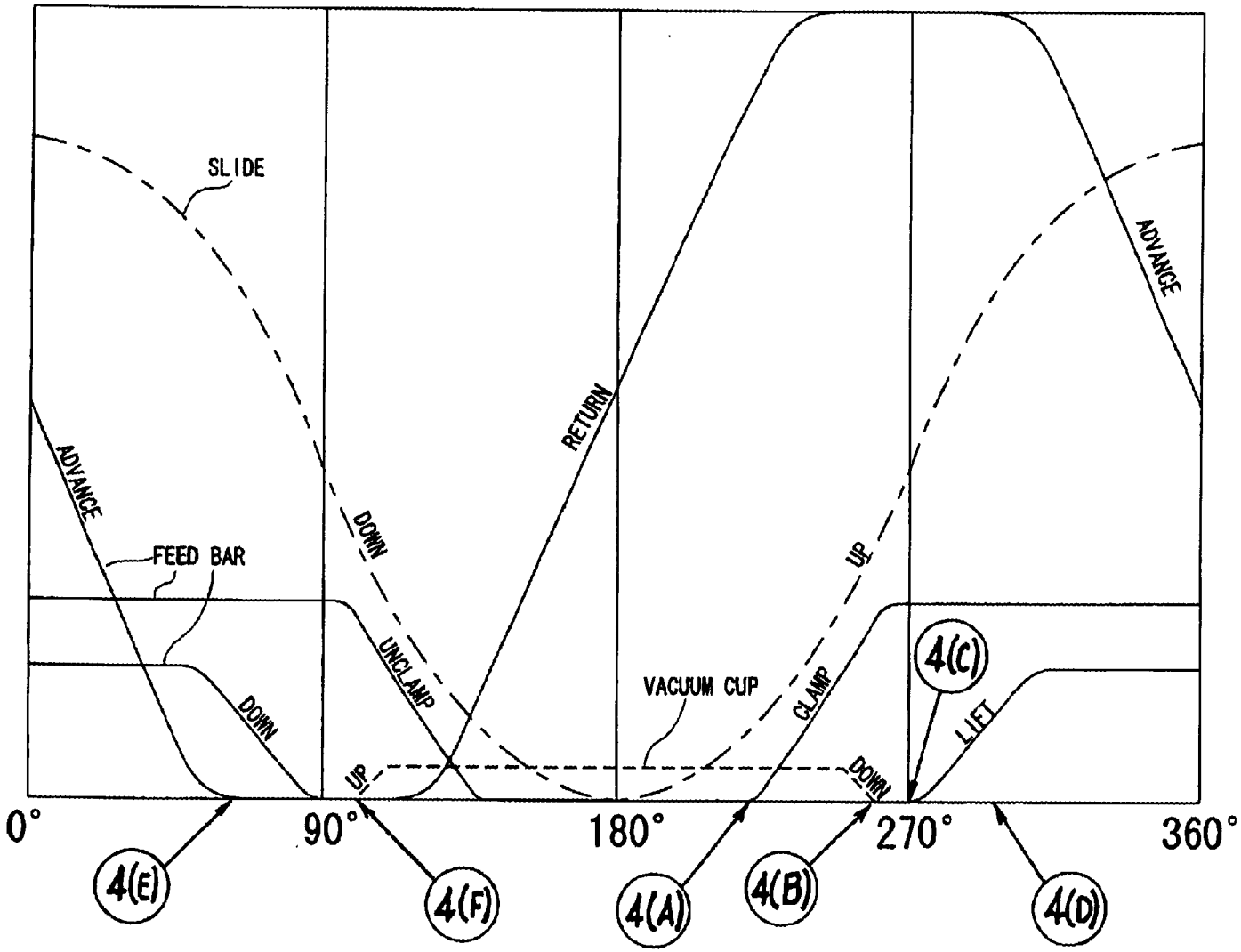
FIG. 5 is a timing chart indicating the actions of the transfer device and the slide of the present invention.

FIG. 5 illustrates a timing chart that shows when the motions of the slide of the press are combined with the motions of feed bar 6 and blank attachment member 18. This timing matches the movements illustrates in FIGS. 4A–4F. The horizontal axis is the crank angle of the press. According to the timing chart of FIG. 5, the crank angle for each of the stages illustrated in FIGS. 4A–4F is approximately the following: FIG. 4A is at 225 degrees, FIG. 4B is at 260 degrees, FIG. 4C is at 270 degrees, FIG. 4D is at 300 degrees, and FIG. 4E is at 60 degrees, FIG. 4F is at 100 degrees.

The embodiment in FIGS. 4A–4F illustrate a three dimensional motion of the feed bar 6. However, two-dimensional motion is also possible. Two-dimensional motion is defined as the feed bar 6 clamping and holding the partially fabricated product. In addition, blank attachment member 18 is lowered, attaches to the blank, is raised, then advances. Feed bar 6 then unclamps, and the partially fabricated product is released (mounted). In addition, blank attachment member 18 is lowered, the attachment released, and then blank attachment member 18 is raised.

Furthermore, with the above embodiment, a vacuum cup is used for blank attachment member 18. However, as described above, a magnet may also be used. Thus, it is known by those skilled in the art that the optimal blank attachment member is selectable according to the type of blank material.

In the present invention, cross bars 17 having blank attachment member 18 are used for carrying the blank material to first stage 24 when sagging of the blank material is a concern. For second stage 25 and beyond, the blank material is molded and rigid, and, thus suitable fingers 23 are used for the transfer of these blank materials. In other words, with one machine, two types of transfer devices are used together. As a result, there are advantages in terms of cost and high productivity in the various processing from small blank materials to large blank materials.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A transfer device for transferring a material, comprising:

a plurality of stages disposed in a transfer direction, including an idle stage, a first stage, and a second stage;

a plurality of feed rails disposed along said transfer direction, a first transfer system comprising:

a cross bar spanning said feed rails;

an attachment member disposed along said cross bar enabling attachment to said material; and a second transfer system comprising:

a plurality of fingers disposed in relation to said feed rails in a transfer direction, wherein said first transfer system transfers said material from said idle stage to said first stage and said second transfer system transfers said material from said first stage to said second stage, thereby said transfer device enables movement of said material at a high rate of speed while maintaining a compact size.

2. The device as described in claim 1, wherein said each of said feed rails further comprises:

a plurality of feed bars disposed in series; and a plurality of joints connecting said feed bars, wherein said joints are detachable.

3. The device as described in claim 2, wherein said feed bars comprise:

a second guide means disposed along said feed bars for slidingly guiding said cross bar.

4. The device as described in claim 1, wherein each of said feed rails comprises:

a first guide means disposed along said feed rails for slidingly guiding said cross bar.

5. The device as described in claim 1, wherein:

said feed rails are disposed parallel to each other and disposed in said transfer direction;

a plurality of cross bars spanning said feed rails.

6. The device as described in claim 5, wherein said first transfer system further comprises:

a plate disposed between said cross bars;

a rack disposed in a center position between said cross-bars;

a pinion rotatably integral to said plate and said rack meshes with said pinion forming a rack and pinion mechanism, wherein said rack and pinion mechanism has a clamp position and an unclamp position and a movement of said cross bars causing said rack and pinion mechanism to switch between said positions.

7. The device as described in claim 1, wherein each of said feed rails has a lift position and a down position, wherein said lift position raises said transfer device above a predetermined point and said down position lowers said transfer device below said predetermined point.

8. The device as described in claim 1, wherein said attachment member is a magnet.

9. The device as described in claim 1, wherein said attachment member comprises:

a vacuum cup, contacting said material;

a piston rod attached to said vacuum cup;

a cylinder, said piston rod slidingly connected to said cylinder;

a vacuum generating device fluidly connected to said vacuum cup and fluidly connected to said cylinder, wherein said vacuum generating device generates a vacuum condition, said material being attached to said vacuum cup using said vacuum, and said piston rod being drawn into said cylinder.

10. A transfer device, as described in claim 1, wherein:

a rack is formed in a center portion of said pair of cross bars (17);

one of facing ends of cross bars (17) are fixed on guides 21, which are affixed to upper surfaces of feed bars (6), and the other ends are slidably guided;

in addition, a pinion is rotatably provided on a plate (20) that is joined near a center part of said cross bars (17), and said pinion meshes with said rack to construct a rack-pinion mechanism.

11. A transfer device, being a transfer device having a pair of parallely arranged feed bars, wherein:

two types of transferring devices are jointly used;

one type of transferring device includes a pair of cross bars (17) that span said feed bars and that have a blank attachment member (18) and are used for transferring a blank material, which has been brought to an idle stage (23) of said transfer device, to a next first stage;

a second type of transferring device is fingers (22) for gripping blank end parts and are used for each downstream stage from a second stage (25) and beyond of said feed bars (6).

* * * * *